US012747589B2

(12) United States Patent
Price

(10) Patent No.: US 12,747,589 B2
(45) Date of Patent: Sep. 29, 2026

(54) ROBOTICS DOME CONSTRUCTION SYSTEM AND METHOD

(71) Applicant: Nephi Price, Rigby, ID (US)

(72) Inventor: Nephi Price, Rigby, ID (US)

( * ) Notice: Subject to any disclaimer, the term of this patent is extended or adjusted under 35 U.S.C. 154(b) by 254 days.

(21) Appl. No.: 18/588,486

(22) Filed: Feb. 27, 2024

(65) Prior Publication Data

US 2024/0287807 A1 Aug. 29, 2024

Related U.S. Application Data

(60) Provisional application No. 63/487,066, filed on Feb. 27, 2023.

(51) Int. Cl.
*E04D 13/03* (2006.01)
*E04D 13/16* (2006.01)
*E04D 5/08* (2006.01)

(52) U.S. Cl.
CPC ..... *E04D 13/03* (2013.01); *E04D 13/1606* (2013.01); *E04D 5/08* (2013.01)

(58) Field of Classification Search
CPC ..... E04D 5/08; E04D 13/03; E04D 13/1606; E04B 1/3211; E04B 7/08
USPC ..... 52/81.3
See application file for complete search history.

(56) References Cited

U.S. PATENT DOCUMENTS 1,899,924 A * 3/1933 Broda ..... E04B 7/08 52/643
3,426,498 A * 2/1969 Ezell ..... E04C 3/292 52/695
3,651,612 A * 3/1972 Schmitt ..... E04C 3/16 52/642
3,708,942 A * 1/1973 Leonard ..... F16B 15/0046 52/693
3,908,975 A * 9/1975 Bryant ..... E04B 1/3211 269/910
3,914,077 A * 10/1975 Lodes ..... E04B 1/166 264/45.2
3,965,624 A * 6/1976 Madonna ..... E04G 23/02 362/147
4,001,985 A * 1/1977 Nikolaus ..... E04B 9/32 52/28
4,068,442 A * 1/1978 Troutner ..... E04B 1/32 52/480
4,077,177 A * 3/1978 Boothroyd ..... E04B 1/32 52/80.1

(Continued)

FOREIGN PATENT DOCUMENTS

DE 102016001760 A1 * 8/2017 ..... E04G 21/04

*Primary Examiner* — James M Ference

(57) ABSTRACT

The system allows a user to construct a dome while masking the dome within a structure built with traditional wood building materials. The system may include a membrane material that defines the walls and roof of the dome. The system may also have brackets that are placed into the roof formed by the membrane material. After foam has been sprayed, a user may insert wires into the foam. The wires are positioned so as to receive rebar to add structural stability to the dome. A robotic sprayer applies shotcrete to inner walls of the dome, over the foam, wire, and rebar. A traditional roof may be coupled to the completed concrete dome using the brackets that have been embedded throughout the initial construction of the dome.

20 Claims, 15 Drawing Sheets

(56) References Cited

U.S. PATENT DOCUMENTS 4,155,967 A * 5/1979 South ..... E04B 1/3211 264/45.2
4,170,093 A * 10/1979 Cappellini ..... E04G 11/04 264/32
4,173,857 A * 11/1979 Kosaka ..... E04C 3/42 52/642
4,279,680 A * 7/1981 Watson, Jr. ..... E04B 1/3211 264/225
4,324,074 A * 4/1982 South ..... E04B 1/3505 264/45.2
4,352,260 A * 10/1982 Pearcey ..... E04B 1/3211 D25/19
4,365,455 A * 12/1982 Braine ..... E04B 1/164 D25/19
4,439,383 A * 3/1984 Collins ..... E04B 1/3533 264/32
4,442,059 A * 4/1984 Boyce ..... E04B 1/169 264/45.2
4,446,083 A * 5/1984 Nicholls ..... E04B 1/3505 52/2.16
4,488,392 A * 12/1984 Pearcey ..... E04B 1/3211 52/741.11
4,514,347 A * 4/1985 Reed ..... E04B 1/3211 264/269
4,631,867 A * 12/1986 Reed ..... E04B 1/3211 451/361
4,713,916 A * 12/1987 Brooks, Jr. ..... E04B 9/006 362/147
4,879,859 A * 11/1989 Dykmans ..... E04B 1/168 52/745.07
5,094,044 A * 3/1992 Dykmans ..... E04G 11/36 427/508
5,105,590 A * 4/1992 Dykmans ..... E04H 7/20 52/223.3
5,134,830 A * 8/1992 Dykmans ..... E04G 11/36 52/249
5,177,919 A * 1/1993 Dykmans ..... E04C 5/18 52/297
5,305,576 A * 4/1994 Giles ..... E04B 1/3211 264/32
5,361,550 A * 11/1994 Kaden ..... E04B 1/3211 52/80.1
5,408,793 A * 4/1995 Dykmans ..... E04B 1/168 52/80.1
5,772,314 A * 6/1998 Brumer ..... F21S 8/04 362/147
5,851,580 A * 12/1998 Amberg ..... E21D 11/105 118/712
5,918,438 A * 7/1999 South ..... E04B 1/3211 52/80.1
6,240,686 B1 * 6/2001 Mill ..... E04B 1/3205 52/741.12
6,748,712 B2 * 6/2004 Likozar ..... E04B 9/14 52/81.3
7,013,607 B1 * 3/2006 South ..... E04B 1/3211 52/80.1
7,857,024 B2 * 12/2010 Bush ..... E04B 9/006 152/39
8,017,048 B1 * 9/2011 Carter ..... B29C 44/022 264/32
9,194,122 B2 * 11/2015 DaCosta ..... E04B 7/10
10,034,418 B1 * 7/2018 Tuan ..... C04B 28/02
2003/0213186 A1 * 11/2003 Geiger ..... E04B 7/102 52/81.3
2004/0045227 A1 * 3/2004 South ..... E04B 1/3211 52/80.1
2004/0099977 A1 * 5/2004 Trottmann ..... E04G 11/04 264/32
2005/0022461 A1 * 2/2005 Geiger ..... E04B 1/3211 52/81.3
2005/0210767 A1 * 9/2005 DeFever ..... E04B 1/3511 52/80.1
2007/0028531 A1 * 2/2007 Woodcock ..... B63B 1/041 52/79.1
2009/0217930 A1 * 9/2009 Holley ..... E04B 1/3205 52/80.1
2011/0313218 A1 * 12/2011 Dana ..... C10B 53/06 208/400
2012/0186165 A1 * 7/2012 Wilsey ..... E04B 7/08 52/63
2013/0330467 A1 * 12/2013 Bond ..... E21D 11/10 118/695
2015/0239148 A1 * 8/2015 Israel ..... B29C 64/106 425/375
2017/0321438 A1 * 11/2017 South, Jr. ..... E04B 1/169
2019/0107228 A1 * 4/2019 Ehsani ..... F16L 9/133
2019/0234029 A1 * 8/2019 Raman ..... E01C 23/00
2021/0079646 A1 * 3/2021 Kreizinger ..... E04G 11/08
2021/0115693 A1 * 4/2021 Taylor ..... E04B 1/34
2021/0189747 A1 * 6/2021 Pearson, Jr. ..... B25J 5/007
2023/0053099 A1 * 2/2023 Mehta ..... F17C 1/06
2024/0287807 A1 * 8/2024 Price ..... E04B 7/08

* cited by examiner

ROBOTICS DOME CONSTRUCTION SYSTEM AND METHOD

CROSS-REFERENCE TO RELATED APPLICATIONS

This application claims the benefit of U.S. Provisional Application Ser. No. 63/487,066, filed on Feb. 27, 2023, which is incorporated herein by reference.

TECHNICAL FIELD

The present disclosure relates to a method of constructing a dome enclosed within a residential house or other structure. More particularly, the present disclosure relates to a method of robotically applying a shotcrete dome roof and walls, with optional embedded brackets, and an optional wood frame roof structure.

BACKGROUND

Domes have been constructed for thousands of years. One of the earliest domes known to man is the Pantheon built by the Romans. Since then, domes have been erected across the world. Contemporary domes are used for a number of reasons, such as for commercial purposes, safety, home living, military, and for many other reasons. While some have utilized domes as residential homes, most have not turned to such designs often due to the aesthetics being less than appealing to some.

Dome houses have many advantages that are not found in wood-structured homes. Some of these advantages may include structural stability during tornadoes, hurricanes, wildfires, and other natural disasters. Even with the many advantages inherent in domes, the United States, in particular, has focused on building wood-structured homes. Accordingly, individuals living in areas with widespread risk of tornados and hurricanes often use shelters or concrete community structures for safety. Wood-structured homes in these areas are often damaged due to natural disasters. In areas of wildfire risk, homes and cabins are often lost to fires each year. In addition, due to the recent labor shortages and increase in building costs in the country, many individuals and families will go homeless if their houses are lost from natural disasters, fires, etc.

Accordingly, there is a need for safe, attractive, cost-effective dome homes, including homes with traditional wood-structured aesthetics, that can be built quickly and that keep families safe from natural disasters. The present invention seeks to solve these and other problems.

SUMMARY OF EXAMPLE EMBODIMENTS

In one embodiment, a robotics dome construction system allows a user to construct a dome while masking the dome within a structure built with traditional wood building materials. The dome and the structure may be constructed as a single unit. The system may comprise a membrane material that defines the walls and roof of the dome. The walls of the dome may also be constructed by using insulated concrete forms (ICF). The system may also comprise brackets that are placed into the roof formed by the membrane material. Foam may then be sprayed over an interior surface of the membrane. After the foam has been sprayed, a user may insert wires into the foam. The wires are positioned so as to receive rebar to add structural stability to the dome.

A robotic sprayer applies shotcrete to inner walls of the dome, over the foam, wire, and rebar and, if desired, on an outer surface of the dome. The robotic sprayer may be programmed to spray various sizes of domes, both in height and width. The robotic sprayer may be programmed to apply wet shotcrete automatically or may be controlled by a manipulator.

The system may further include a traditional roof that is coupled to a top of a completed dome, which adds to the traditional look, feel, and appeal of a traditional home. The traditional roof may comprise standard wood trusses, plywood sheeting, and other standard roofing materials found in traditional roof-built structures. The traditional roof may be coupled to the completed concrete dome using brackets that have been embedded in the initial construction of the dome.

In one embodiment, a method of constructing a dome within a structure comprises building a dome that is defined by a material membrane; inserting brackets into the roof form of the material membrane; spraying interior surface of the dome with foam; placing wire into the foam; coupling rebar to the wire; using a robotic sprayer that applies shotcrete to an interior surface of the dome; and coupling a traditionally designed roof and structure to the brackets embedded in dome.

DETAILED DESCRIPTION OF EXAMPLE EMBODIMENTS

Figure 1:
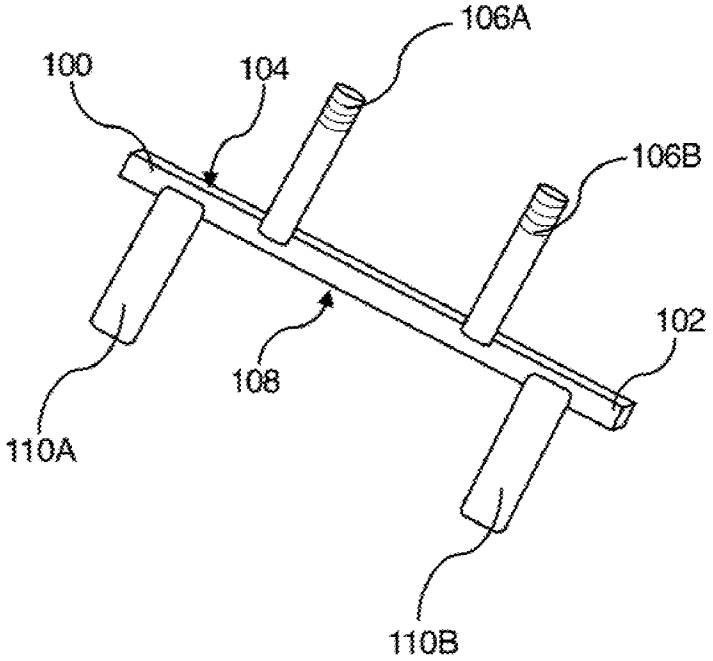
FIG. 1 illustrates a perspective view of a bracket of a robotics dome construction system and method.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms.

As previously described, there is a need for safe, attractive, cost-effective dome homes, including homes with traditional wood-structured aesthetics, that can be built quickly and that keep families safe from natural disasters.

As seen throughout the world, domes have been an important part of history for thousands of years. Some of the earliest domes were erected by the Romans. While domes are still presently built, the manner in which they are built and the materials used vary drastically from those built centuries ago. Due to new material and building methods, domes today are built to withstand natural disasters, such as wildfires, tornadoes, and hurricanes. While some have utilized domes as residential homes, most have not turned to such designs often due to the designs being less than appealing to some. Accordingly, wood-structured homes are prevalent throughout the United States, even though they offer little to no protection from natural disasters.

The system described herein comprises a robotic sprayer system that is preprogramed to the dimensions of a dome so as to properly spray shotcrete thereon. Using a robotic sprayer allows shotcrete to be applied precisely and quickly, thereby keeping labor costs down. The system includes utilizing a membrane material to define the shape of the dome, spray foam, rebar, brackets, and the shotcrete applied by the robotic system. Further, the system includes building materials to erect a traditional wood roof that is configured to be coupled to an upper surface of the dome via the brackets. It will be appreciated that the system and method described herein allows a user to benefit from the inherent protective qualities of a dome while masking the dome by placing a typical wood-based roof thereon. Accordingly, a user may enjoy the benefits of having a home or a business inside a dome while having a safe, attractive, cost-effective structure that can be built quickly and precisely, using robotically programmed shotcrete sprayers. It will be appreciated that the structure with a dome therein may keep families safe from natural disaster, but still have the aesthetics of a traditionally built structure (e.g., wood-built home).

The method described herein comprises building a dome that is defined by a material membrane; inserting brackets into the roof form of the material membrane; spraying interior surface of the dome with foam; placing wire into the foam; coupling rebar to the wire; using a robotic sprayer that applies shotcrete to an interior surface of the dome; and couple traditionally designed roof to brackets embedded in the dome; and constructing structure around the dome.

As shown in FIGS. 1 and 7-15, in one embodiment, a robotics construction system (hereinafter referred to as the "system") allows a user to construct a dome 101 while masking the dome 101 within a structure 103 (e.g., residential or commercial buildings/first structure) built with traditional wood or metal building materials. The dome 101 and the structure 103 may be constructed as a single unit. The dome 101 may receive traditionally wood-built rooms that couple to the sides thereof so as to mask portions of the dome 101 and provide additional space. In some embodiments, more than one dome may be built to add additional space to the structure.

The system may comprise a membrane material 105 that defines the walls and roof of the dome 101. The membrane material 105 may comprise a polyvinyl chloride (PVC) membrane. In other embodiments, the membrane material 105 may include tarps or cloth fabrics. While the walls and roof of the dome may be constructed by using only the membrane material 105, it will be understood that the walls of the dome may also be constructed by using insulated concrete forms (ICF) 107. It will be appreciated that the construction of the dome 101 may be performed via any other known methods in the industry. The system may also comprise brackets 100 that are placed into the roof 109 formed by the membrane material 105. In some embodiments, additional anchors may be used, such as concrete anchor bolts, with the brackets or in place of the brackets. The brackets 100 may comprise a platform 102 with an upper surface 104. The upper surface 104 may comprise a first shaft 106A and a second shaft 106B. The first and second shafts 106A, 106B may both include threaded ends to receive, for example, nuts. The first and second shafts 106A, 106B may be secured to the roof 109 so that the first and second shafts 106A, 106B may extend upward above an upper surface of the roof. The brackets 100 may further comprise a lower surface 108 that includes a first panel 110A and a second panel 110B. The first and second panels 110A, 110B may interact with wire 112 and rebar 114 discussed below. In some embodiments, knife plates 116 may also be coupled to the roof, similar to the brackets 100, if a second story floor is desired.

Foam 118 may then be sprayed over an interior surface of the membrane 105. After the foam 118 has been sprayed, a user may insert wires 112 into the foam 118 at a predetermined depth so as to leave a portion of the wire protruding. The wires 112 are positioned so as to receive rebar 114 to add structural stability to the dome 101. While rebar is discussed, it will be appreciated, ropes, shafts, or other supporting members may be used. It will be understood that the foam may be sprayed by hand or through robotic spraying mechanisms similar to those discussed below for the shotcrete.

A robotic sprayer 120 may be configured to apply shotcrete 121 to inner walls of the dome 101, over the foam 118, wire 112, and rebar 114 and if desired on an outer surface of the dome 101. In some embodiments, other compounds may be used, such as plastics and rubbers, to apply to the inner walls. The robotic sprayer 120 may be programmed to spray various sizes of domes, both in height and width. The robotic sprayer 120 may be programmed to apply wet shotcrete automatically or may be controlled by a manipulator 122 (i.e., robotic arm). In addition, the robotic sprayer 120 may be attached to a man lift, fork lift, or crane. While the system discusses the robotic sprayer, it will be understood that, in some embodiments, hand spraying may also be used in the system. It will be appreciated that there are many benefits to using a robotic sprayer. Some of these benefits may include increased production, safety, precision in applying shotcrete, and decreased labor costs. Any other materials typically needed in a dome building process may also be used in this system.

The system may further include a traditional roof 124 of the structure 103 that is coupled to a top of a completed dome 101, which adds to the traditional look, feel, and appeal of the structure. The traditional roof 124 may comprise standard wood trusses 126, plywood sheeting 128, and other standard roofing materials found in conventional roof-built structures. The traditional roof may be coupled to the completed concrete dome 101 using the brackets 100 that have been embedded in the initial construction of the dome. More specifically, the first and second shafts 106A, 106B may be used to couple the wood framing of the traditional roof 124 to the dome 101. By attaching the wood-framed roof 124 to these embedded brackets 100, the roof may be strengthened enough to withstand harsh elements and even natural disasters. It will be noted that the overall appearance internally of this structure involves curved concrete walls and a dome shaped concrete roof. On the outside, the structure includes curved walls and a traditionally designed roof, which can take on numerous appearances and materials according to an individual's preference.

Figure 2:
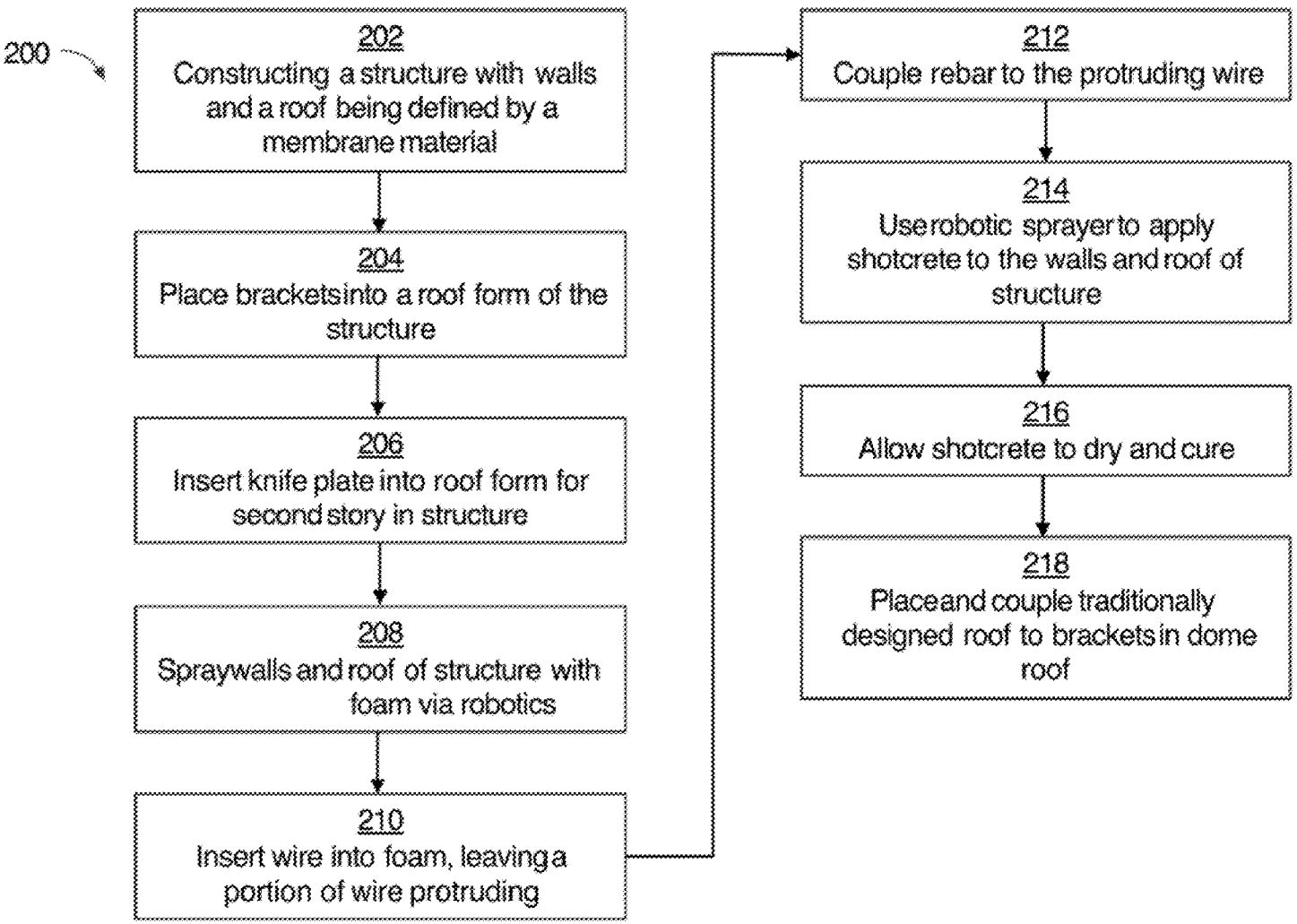
FIG. 2 illustrates a flowchart of a robotics dome construction system and method.

As shown in FIG. 2, in one embodiment, a method of constructing a conventional building with a dome therein 200 comprises a user constructing a first structure (e.g., dome) with walls and a roof form, the shape being defined by a membrane material, such as polyvinyl chloride (PVC) membrane at step 202. The wall shape may also be formed via ICF block, tarps, or cloth fabrics. At step 204, the user places brackets into a roof form of the structure. In some embodiments, additional anchors may be used, such as concrete anchor bolts, with the brackets or in place of the brackets. At step 206, the user inserts knife plates in roof form for second story in structure. At step 208, the user sprays walls and roof of structure with foam (e.g., spray polyurethane foam). At step 210, the user inserts wire into foam, leaving wire protruding from the foam, or a robotic system may be used to insert the wire. In some embodiments, a second layer of foam may be sprayed over the protruding wires. At step 212, the user may couple rebar to the protruding wire by hand, with a tool, or by a robotic mechanism. While rebar is discussed, it will be understood that ropes, plastic shafts, or any other type of supporting member may be used. At step 214, the user uses a robotic sprayer that has been pre-programmed, by the user, to the exact dimensions of the structure to spray shotcrete to the walls and roof of structure. In some embodiments, compounds other than shotcrete may be used, such as plastics, rubbers, or other compounds, or some combination of shotcrete and another compound may be used. The robotic sprayer may be programmed to apply wet shotcrete automatically or may be controlled by manipulator device. In addition, the robotic sprayer may be attached to a man lift, fork lift, crane, or may be operated by hand. At step 216, the user allows the shotcrete to dry and cure. At step 218, the user places a traditionally designed roof (i.e., trusses) with holes drilled into the wood timber onto the first and second shafts 106A, 106B of the brackets 100 in the dome roof and couples the traditionally designed roof using fasteners (e.g., nut and washer) on the first and second shafts 106A, 106B. The user may erect a second structure (e.g., wood-framed structure) around the first structure and couple it thereto.

Figure 3:
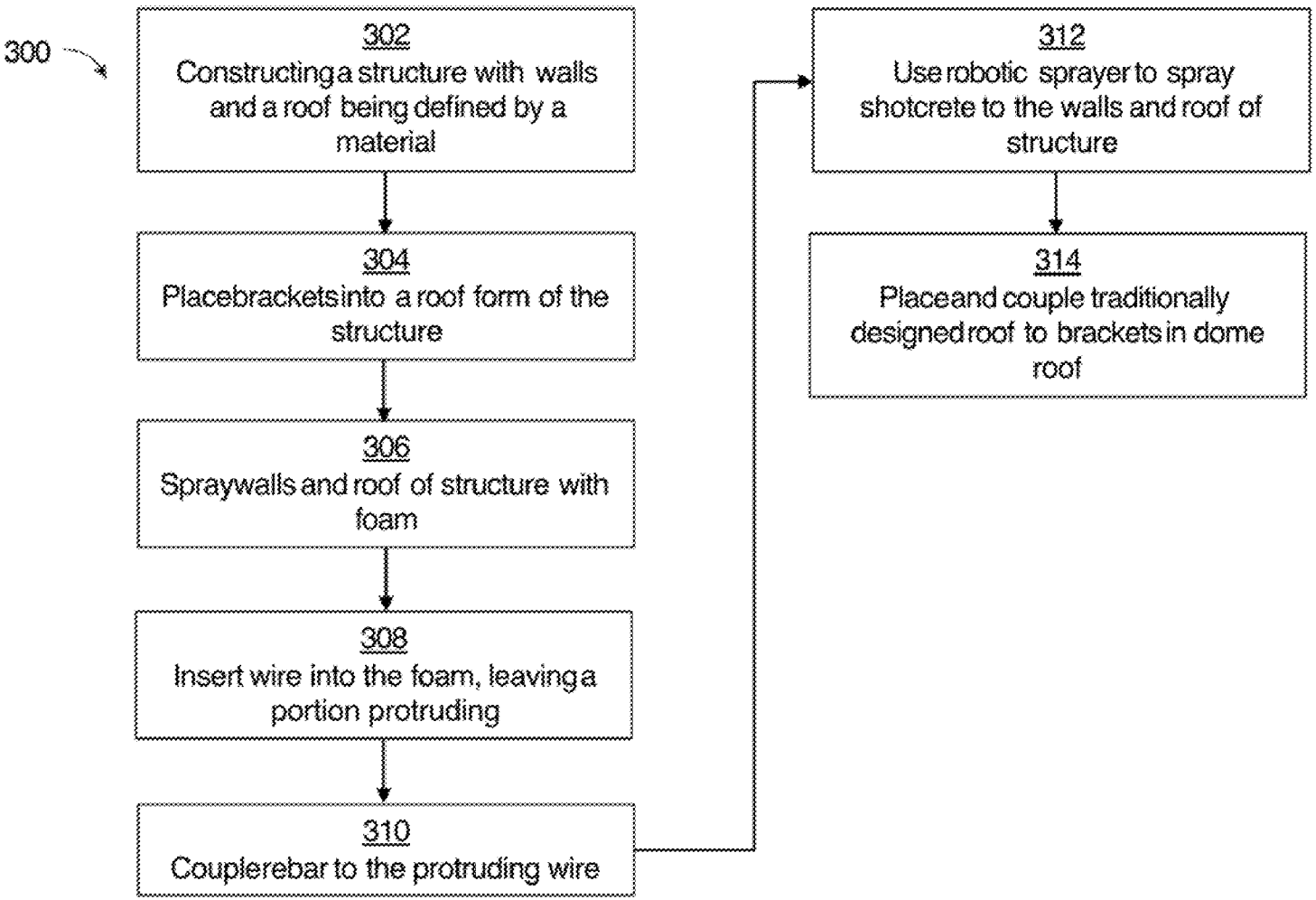
FIG. 3 illustrates a flowchart of a robotics dome construction system and method.

As shown in FIG. 3, in one embodiment, a method of constructing a conventional building with a dome therein 300 comprises a user constructing a structure (e.g., dome) with walls and roof shape being defined by a material, such as a polyvinyl chloride (PVC) membrane at step 302. The wall shape may also be formed via ICF block, tarps, or cloth fabrics. At step 304, the user places brackets 100 into a roof form, such as the membrane, of the structure. In some embodiments, additional anchors may be used, such as concrete anchor bolts, with the brackets or in place of the brackets. At step 306, the user or a robotic sprayer sprays the walls and the roof of the structure with foam (e.g., spray polyurethane foam). At step 308, the user inserts wire into the foam, leaving wire protruding from the foam. In some embodiments, a second layer of foam may be sprayed over the protruding wires. At step 310, the user may couple rebar to the protruding wire by hand, with a tool, or by a robotic mechanism. While rebar is discussed, it will be understood that ropes, plastic shafts, or any other type of supporting member may be used. At step 312, the user programs a robotic sprayer to the exact dimensions of the structure so as to allow the robotic sprayer to spray shotcrete to the walls and roof of structure. In some embodiments, compounds other than shotcrete may be used, such as plastics, rubbers, or other compounds, or some combination of shotcrete and another compound may be used. The robotic sprayer may be programmed to apply wet shotcrete automatically or may be controlled by a manipulator. In addition, the robotic sprayer may be attached to a man lift, fork lift, crane, or may be operated by hand. At step 314, when the shotcrete dries and cures, the user places a traditionally designed roof (i.e., trusses) with holes drilled into the wood timber onto the first and second shafts 106A, 106B of the brackets 100 in the dome roof and couples the traditionally designed roof using fasteners (e.g., nut and washer) on the first and second shafts 106A, 106B. The user may erect a second structure (e.g., wood-framed structure) around the first structure and couple it thereto.

Figure 4:
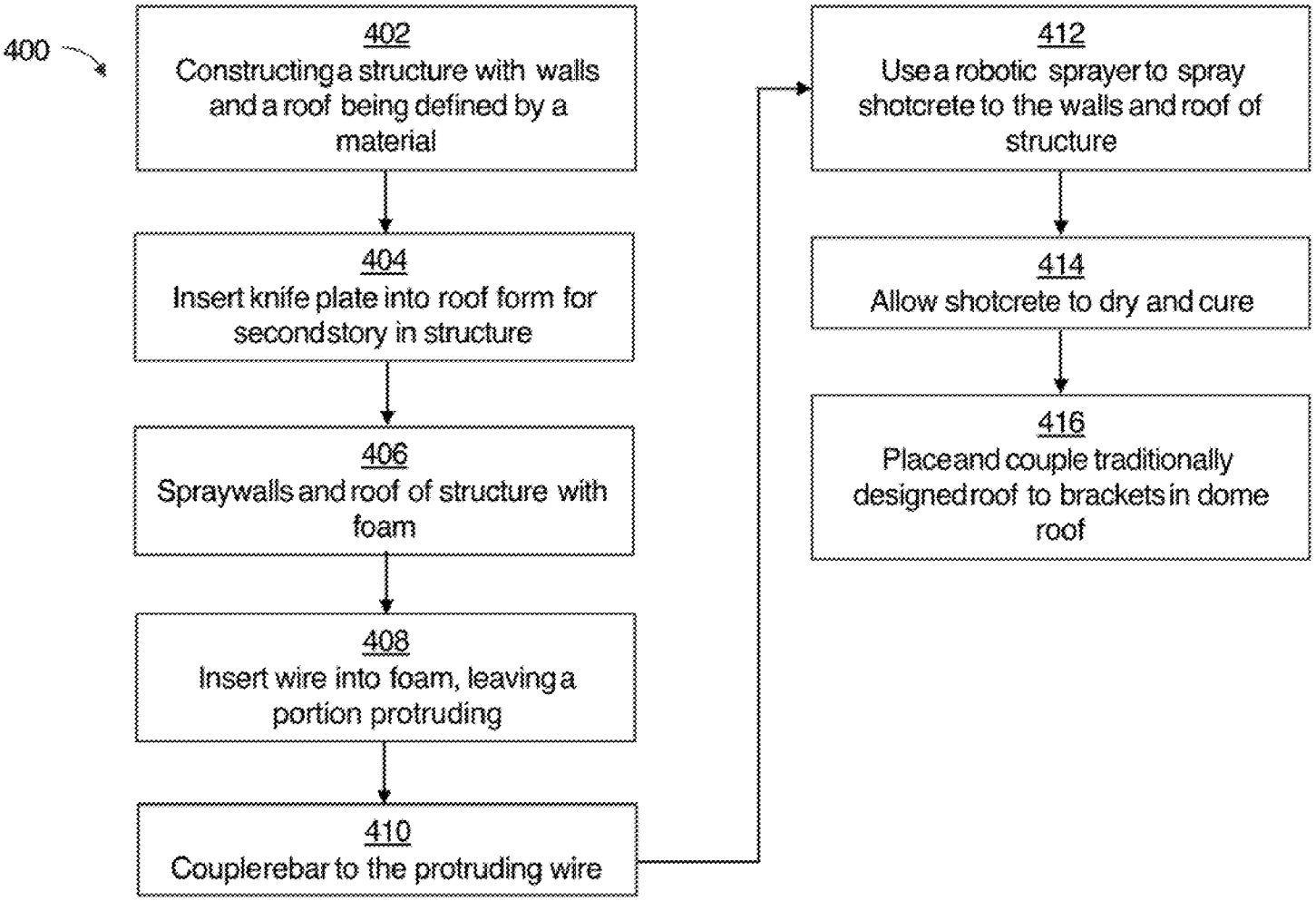
FIG. 4 illustrates a flowchart of a robotics dome construction system and method.

As shown in FIG. 4, in one embodiment, a method of constructing a conventional building with a dome therein 400 comprises a user constructing a structure (e.g., dome) with walls and roof shape being defined by a polyvinyl chloride (PVC) membrane at step 402. The wall shape may also be formed via ICF block, tarps, or cloth fabrics. At step 404, the user inserts knife plates in roof form for a second story in the structure. At step 406, the user sprays walls and roof of the structure with foam (e.g., spray polyurethane foam). At step 408, the user inserts wire into foam a predetermined depth, leaving wire protruding from the foam. In some embodiments, a second layer of foam may be sprayed over the protruding wires. At step 410, the user may couple rebar to the protruding wire by hand, with a tool, or by a robotic mechanism. While rebar is discussed, it will be understood that ropes, plastic shafts, or any other type of supporting member may be used. At step 412, the user uses a robotic sprayer that has been pre-programmed, by the user, to the exact dimensions of the structure to spray shotcrete to the walls and the roof of the structure. In some embodiments, compounds other than shotcrete may be used, such as plastics, rubbers, or other compounds, or some combination of shotcrete and another compound may be used. The robotic sprayer may be programmed to apply wet shotcrete automatically or may be controlled by a manipulator. In addition, the robotic sprayer may be attached to a man lift, fork lift, crane, or may be operated by hand. At step 414, the user allows the shotcrete to dry and cure. At step 416, the user places a traditionally designed roof (i.e., trusses) with holes drilled into the wood timber onto the first and second shafts 106A, 106B of the brackets 100 in the dome roof and couples the traditionally designed roof using fasteners (e.g., nut and washer) on the first and second shafts 106A, 106B. The user may erect a second structure (e.g., wood-framed structure) around the first structure and couple it thereto.

Figure 5:
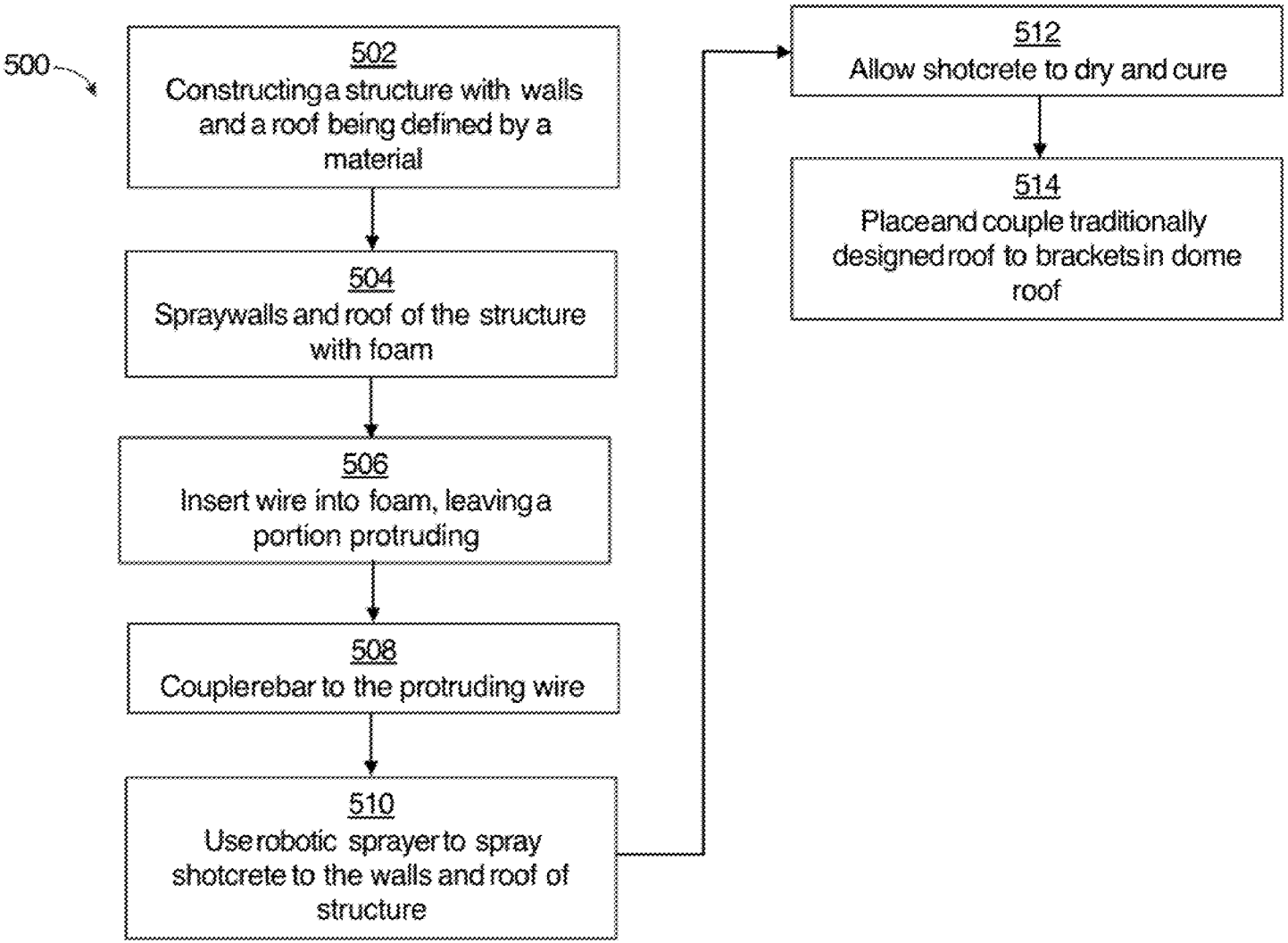
FIG. 5 illustrates a flowchart of a robotics dome construction system and method.

As shown in FIG. 5, in one embodiment, a method of constructing a conventional building with a dome therein 500 comprises a user constructing a structure (e.g., dome) with walls and roof shape being defined by a polyvinyl chloride (PVC) membrane at step 502. The wall shape may also be formed via ICF block, tarps, or cloth fabrics. At step 504, the user sprays walls and roof of structure with foam (e.g., spray polyurethane foam). At step 506, the user inserts wire into foam at a predetermined depth, leaving wire protruding from the foam. In some embodiments, a second layer of foam may be sprayed over the protruding wires. At step 508, the user may couple rebar to the protruding wire by hand, with a tool, or by a robotic mechanism. While rebar is discussed, it will be understood that ropes, plastic shafts, or any other type of supporting member may be used. At step 510, the user uses a robotic sprayer that has been pre-programmed, by the user, to the exact dimensions of the structure to spray shotcrete to the walls and the roof of the structure. In some embodiments, compounds other than shotcrete may be used, such as plastics, rubbers, or other compounds, or some combination of shotcrete and another compound may be used. The robotic sprayer may be programmed to apply wet shotcrete automatically or may be controlled by manipulator. In addition, the robotic sprayer may be attached to a man lift, fork lift, crane, or may be operated by hand. At step 512, the user allows the shotcrete to dry and cure. At step 514, the user places a traditionally designed roof (i.e., trusses) with holes drilled into the wood timber onto the first and second shafts 106A, 106B of the brackets 100 in the dome roof and couples the traditionally designed roof using fasteners (e.g., nut and washer) on the first and second shafts 106A, 106B. The user may erect a second structure (e.g., wood-framed structure) around the first structure and couple it thereto.

In view of the previous methods, it will be understood that in some embodiments a method of using a robotics system may include only the steps of constructing the dome and using a robotics system to spray foam and/or shotcrete.

Figure 6:
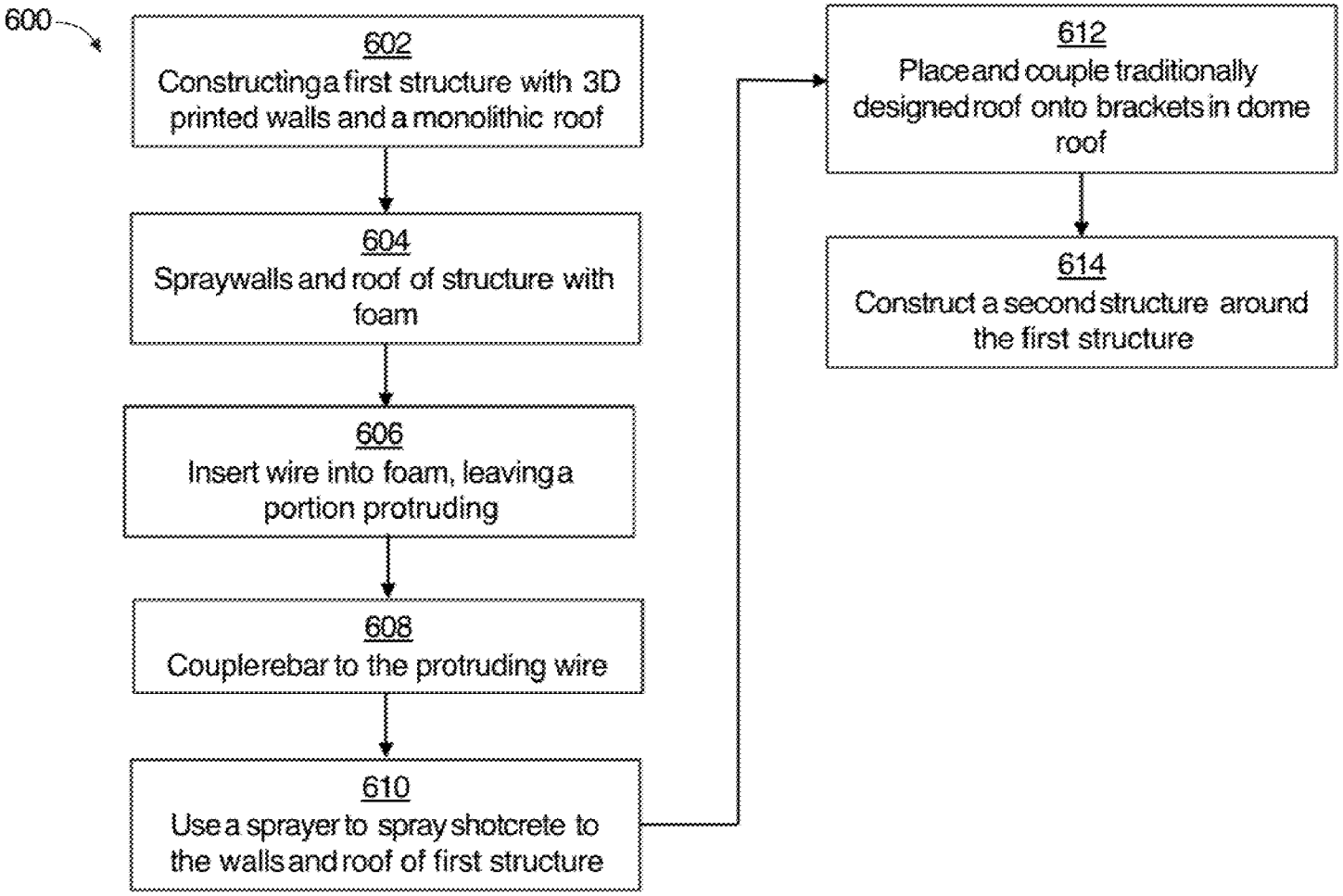
FIG. 6 illustrates a flowchart of a robotics dome construction system and method.
Figure 7:
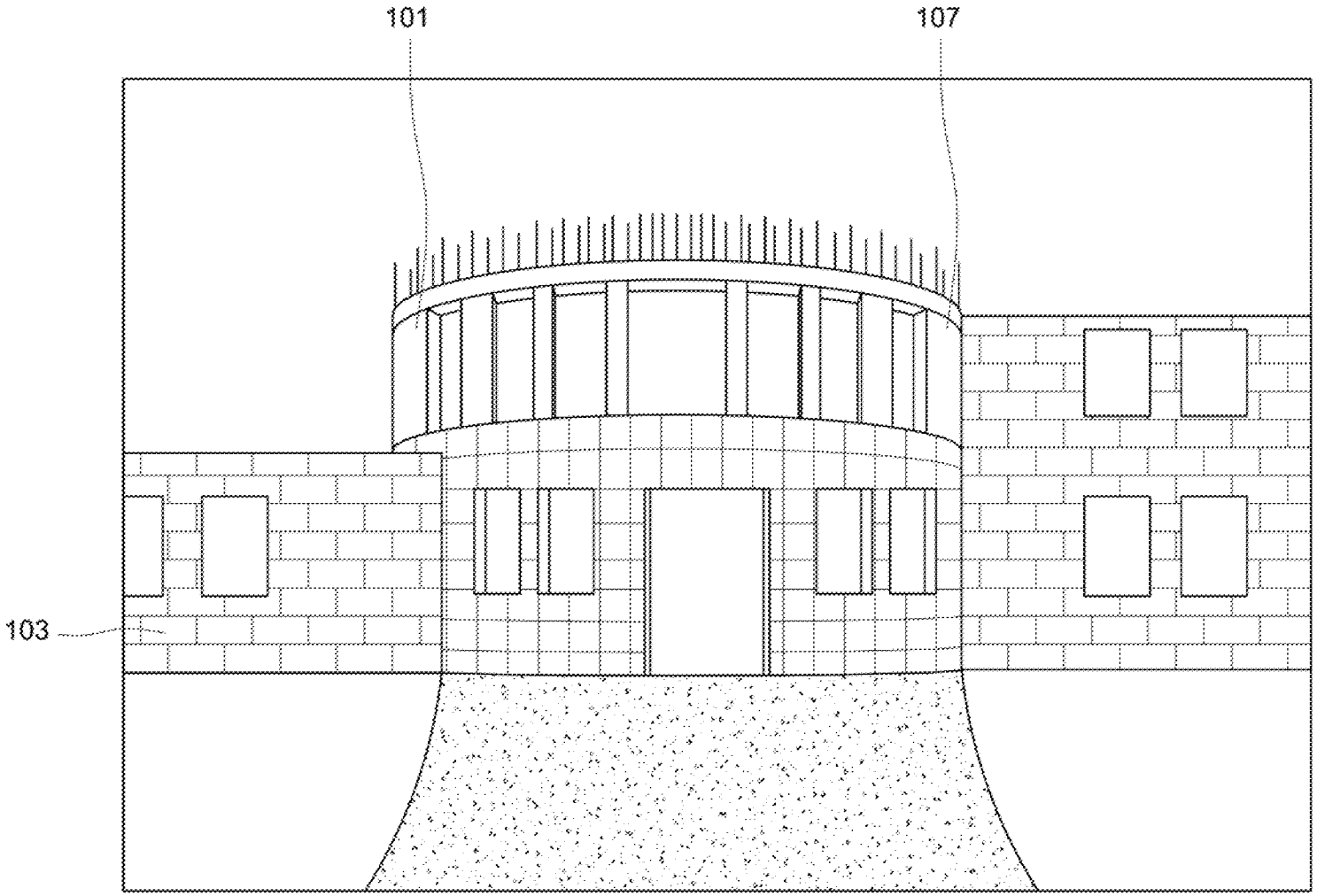
FIG. 7 illustrates a front elevation view of a dome and a structure of a robotics dome construction system and method.
Figure 8:
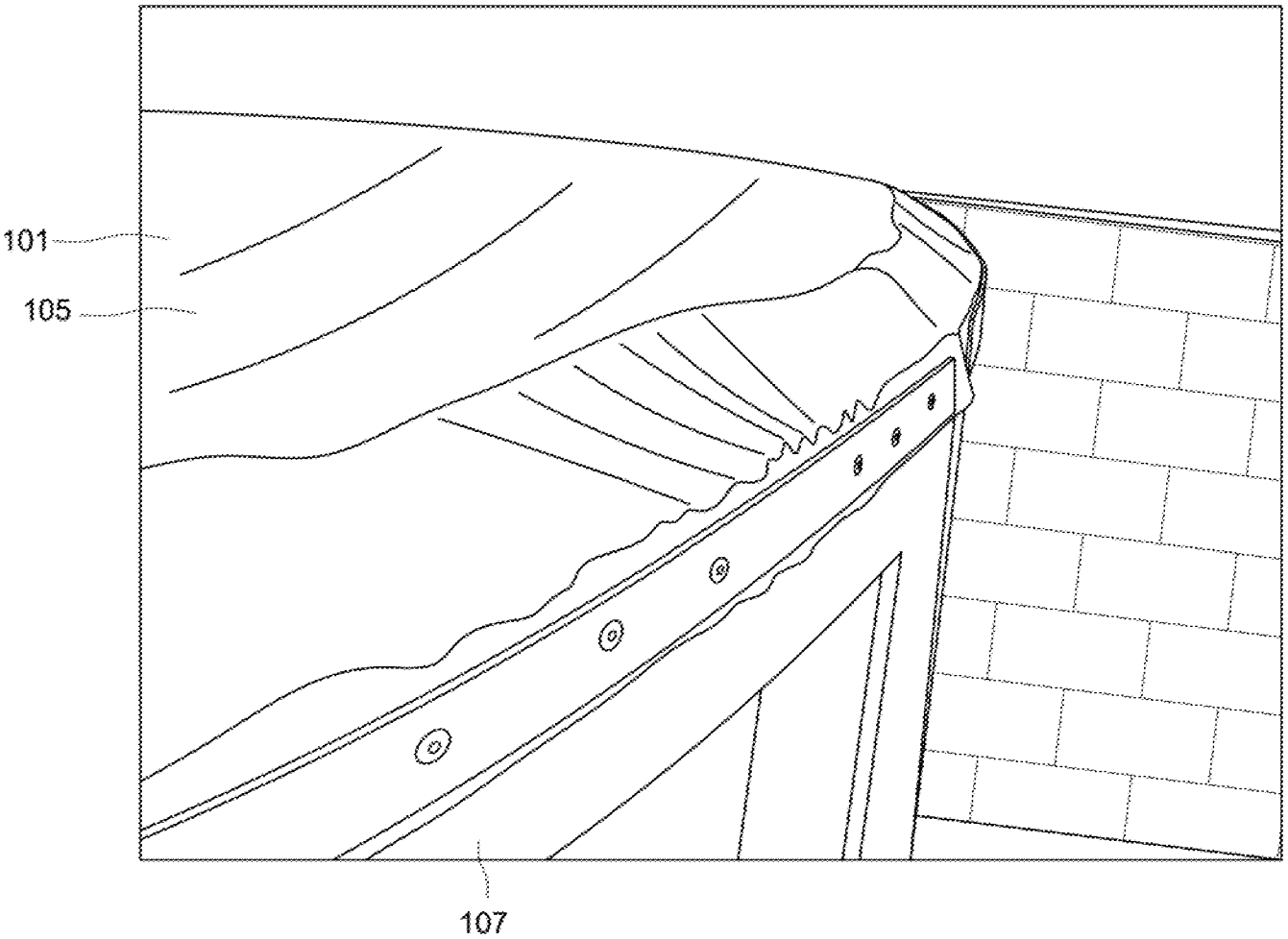
FIG. 8 illustrates a top perspective view of a PVC membrane of a robotics dome construction system and method.
Figure 9:
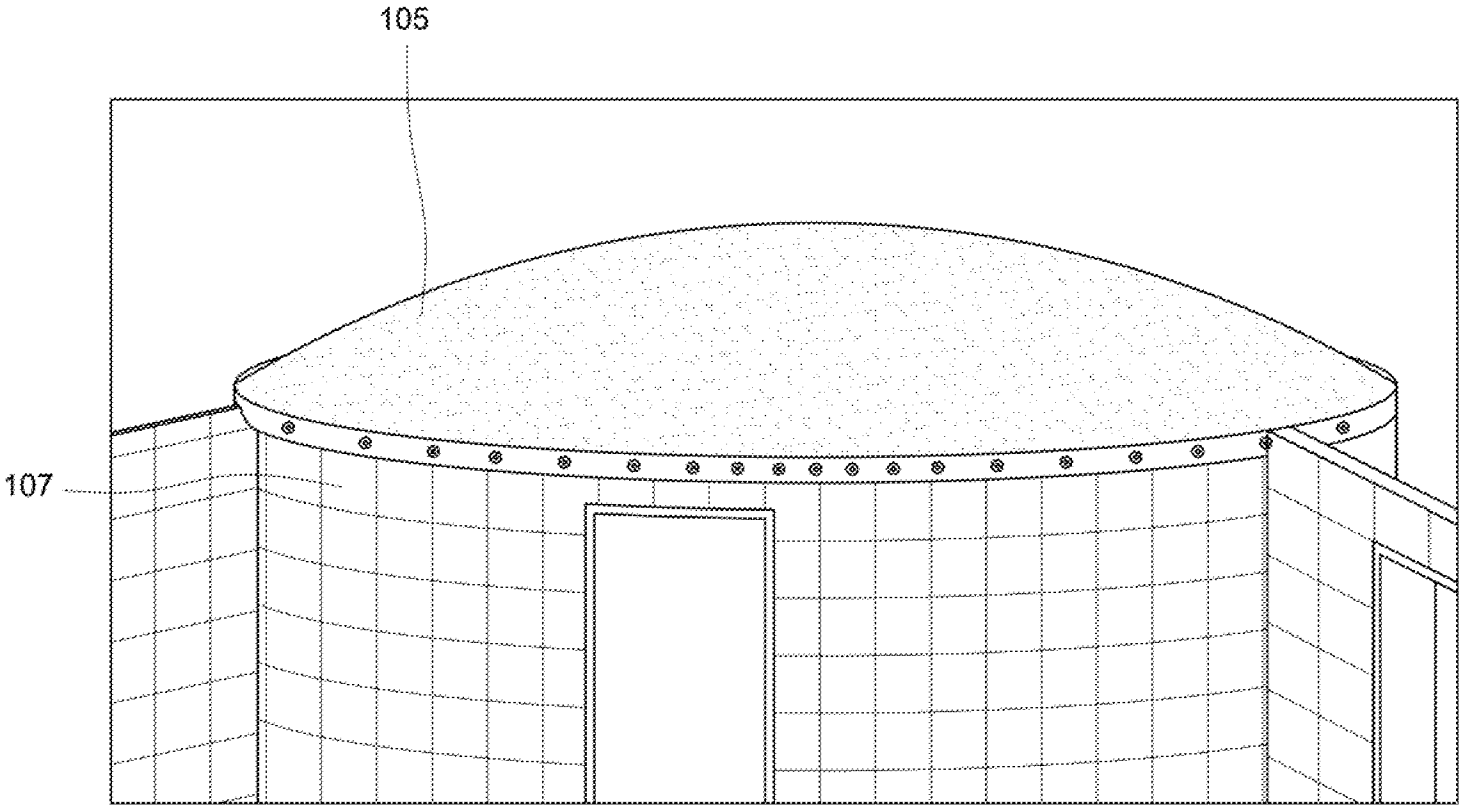
FIG. 9 illustrates a perspective view of an inflated PVC membrane of a robotics dome construction system and method.
Figure 10:
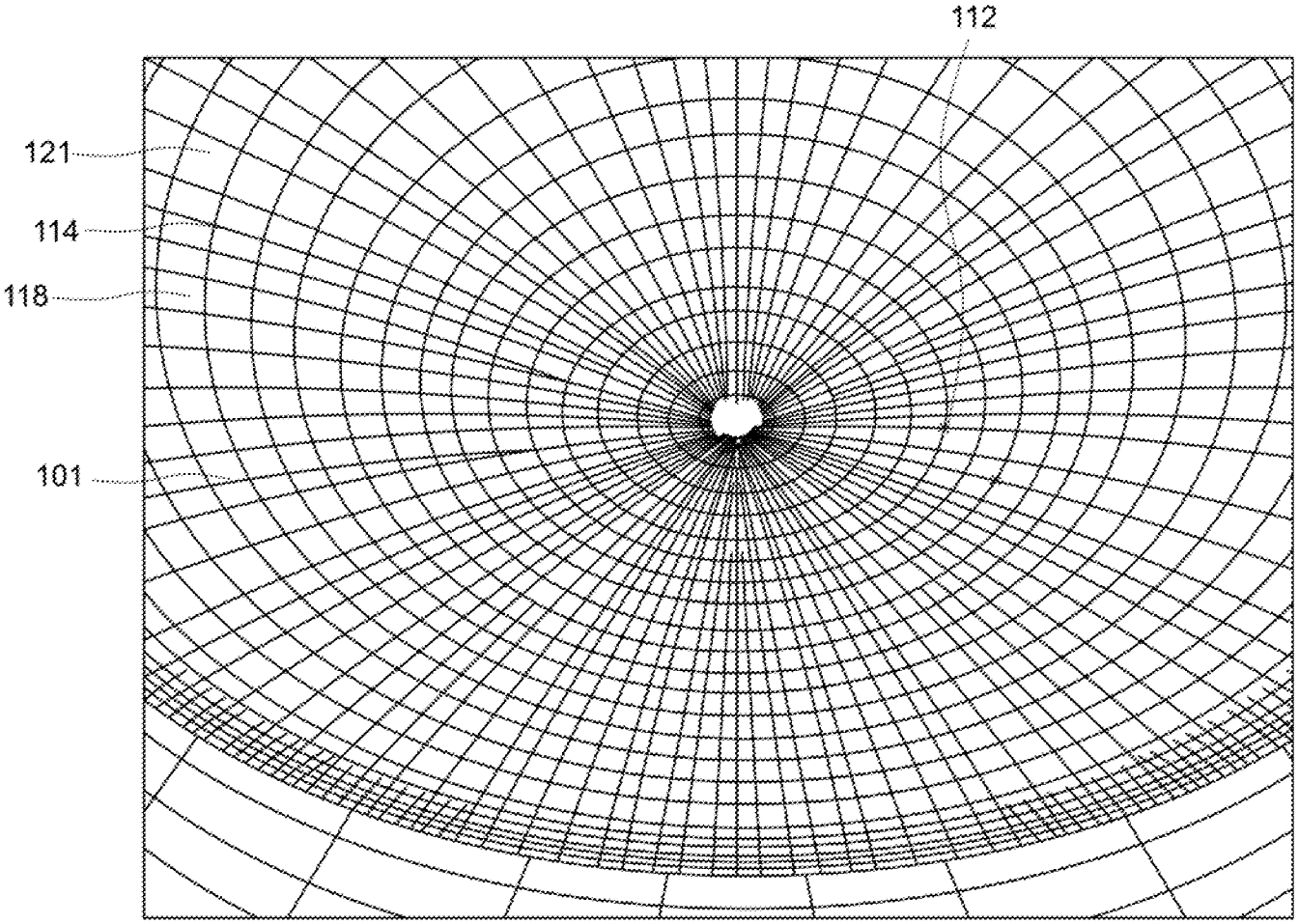
FIG. 10 illustrates a bottom perspective view of a dome of a robotics dome construction system and method.
Figure 11:
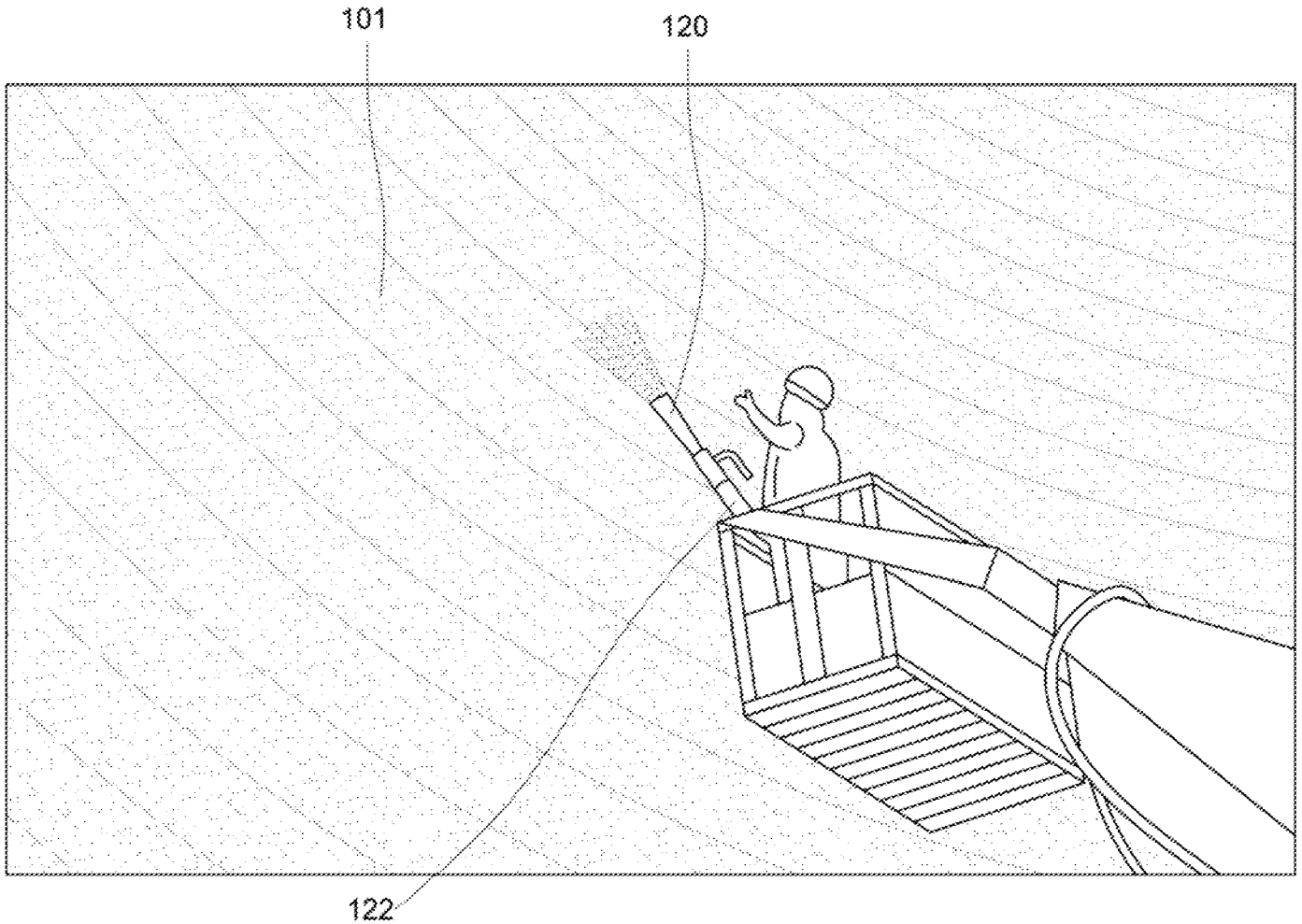
FIG. 11 illustrates a bottom perspective view of a robotic sprayer of a robotics dome construction system and method.
Figure 12:
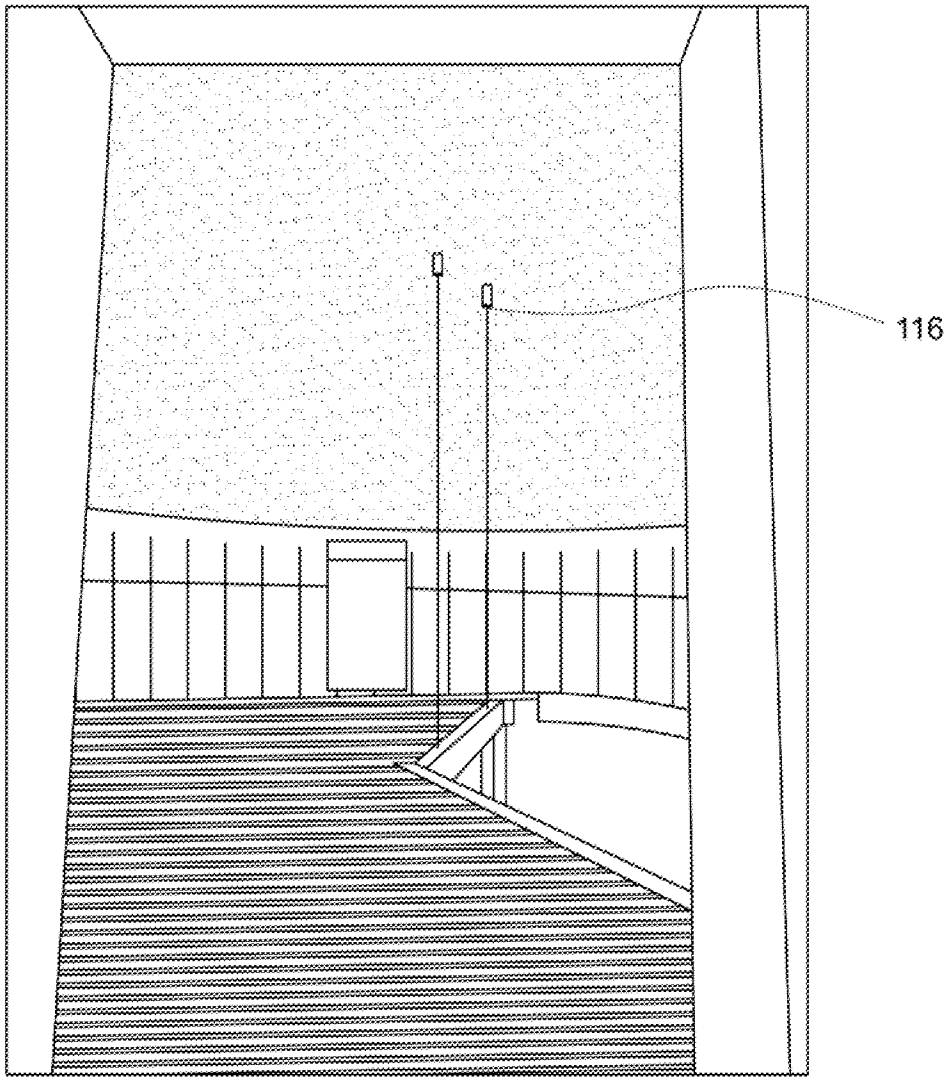
FIG. 12 illustrates a perspective view an interior of a dome of a robotics dome construction system and method.
Figure 13:
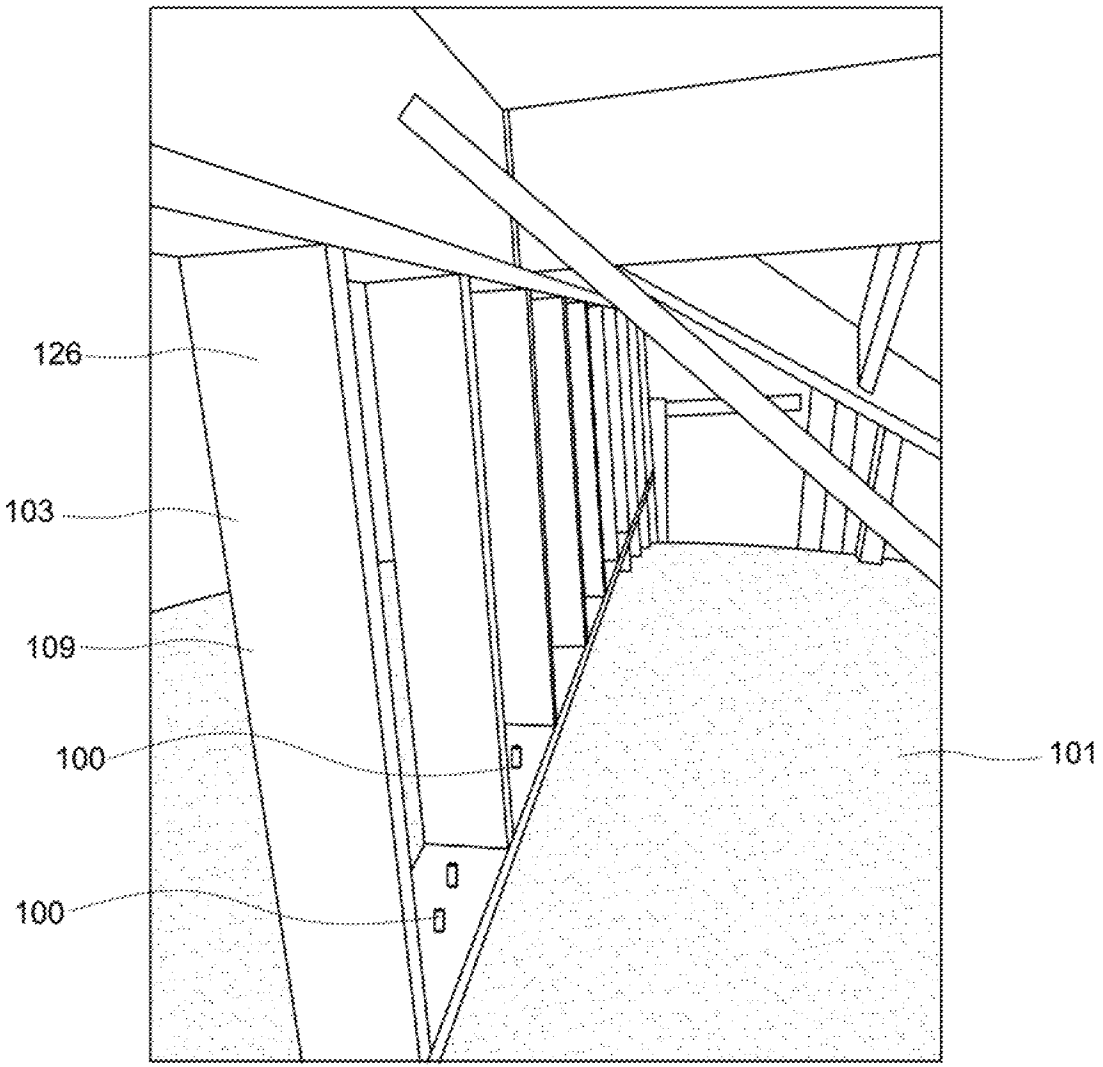
FIG. 13 illustrates a perspective view of a dome of a robotics dome construction system and method.
Figure 14:
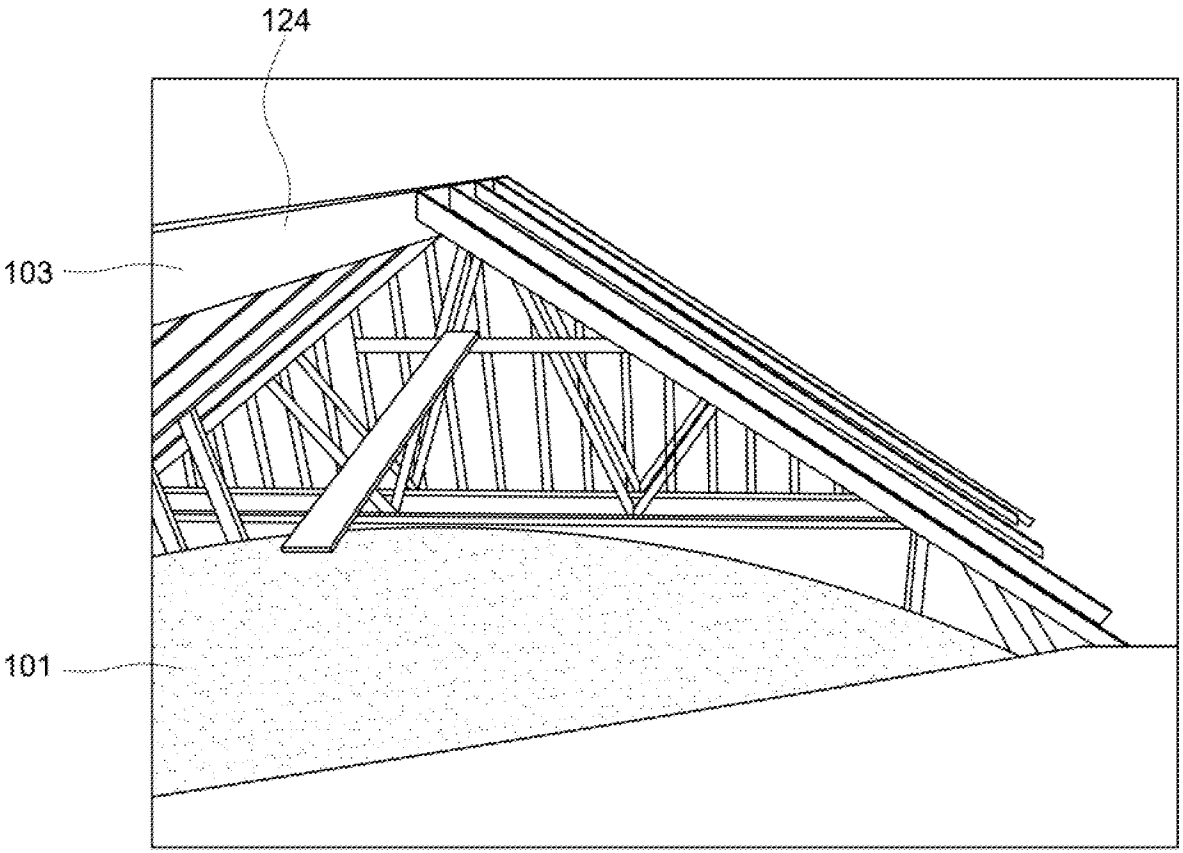
FIG. 14 illustrates a top perspective view of roof framing of a robotics dome construction system and method.
Figure 15:
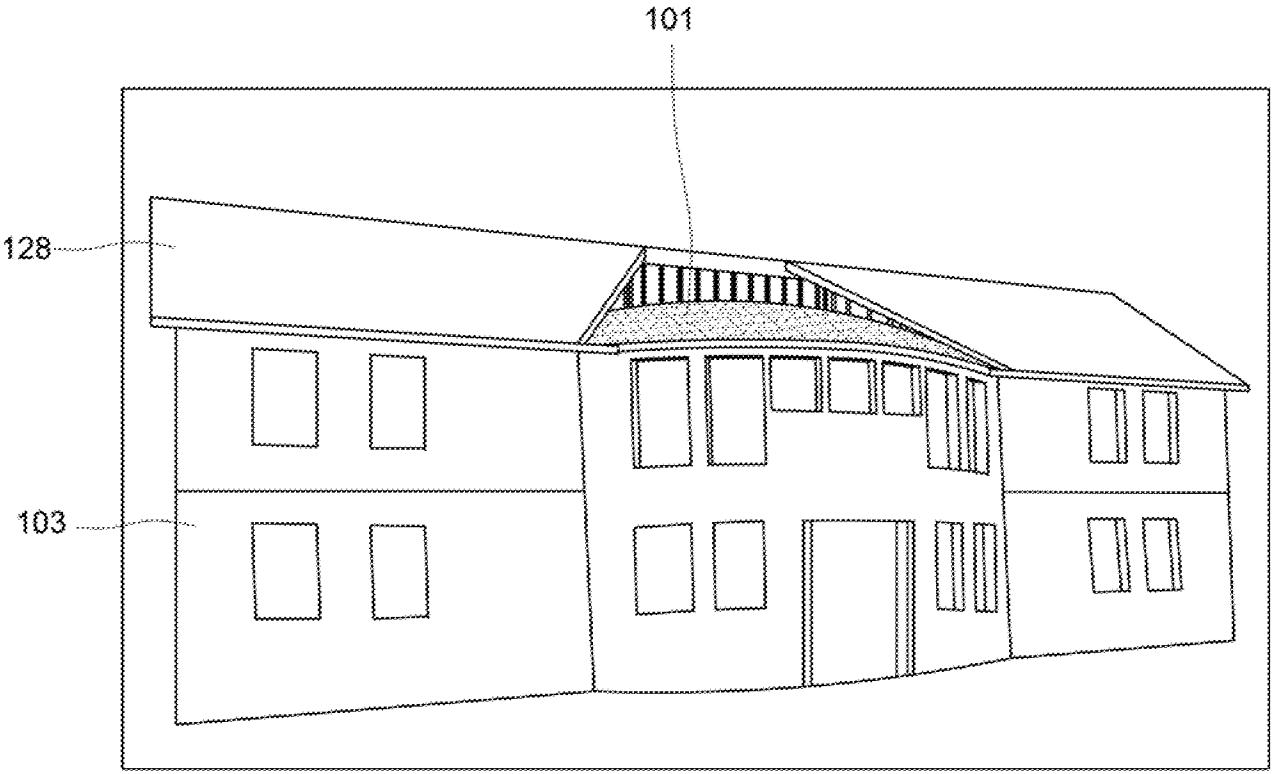
FIG. 15 illustrates a front perspective view of a dome and a structure of a robotics dome construction system and method.

As shown in FIG. 6, in one embodiment, a method of constructing a conventional building with a dome therein 600 comprises a user constructing a first structure (e.g., dome) with walls and a monolithic roof at step 602. The walls of the first structure (e.g., dome) may include 3D printed walls, or any other type of wall (e.g., ICF or wooden created walls). The monolithic roof (i.e., single membrane roof) may be placed on and fastened to the walls. The monolithic roof may be manufactured from a polyvinyl chloride (PVC) membrane. Other materials for the monolithic roof may include cloths, rubbers, etc. The monolithic roof may be fastened to walls so as to create a continuous connection between the walls and the monolithic roof. The monolithic roof may be configured to create a generally arch-shaped or dome-shaped roof. That is, the monolithic roof may be inflated to create the dome or arch shape. The wall shape may also be formed via ICF block, tarps, or cloth fabrics. At step 604, the user sprays an inner surface of the walls and the roof of the structure with foam (e.g., spray polyurethane foam). At step 606, the user inserts wire into foam, leaving wire protruding from the foam. That is, a predetermined length of the wire may be pushed into the foam. In some embodiments, a second layer of foam may be sprayed over the protruding wires. At step 608, the user may couple rebar to the protruding wire by hand, with a tool, or by a robotic mechanism. While rebar is discussed, it will be understood that ropes, plastic shafts, or any other type of supporting member may be used. At step 610, the user may use a robotic sprayer that has been pre-programmed, by the user, to the exact dimensions of the structure to spray shotcrete to the walls and the roof of the first structure. In some embodiments, compounds other than shotcrete may be used, such as plastics, rubbers, or other compounds, or some combination of shotcrete and another compound may be used. The robotic sprayer may be programmed to apply wet shotcrete automatically or may be controlled by manipulator. In some embodiments, the shotcrete may be applied via a hand sprayer. In addition, the robotic sprayer may be attached to a man lift, fork lift, crane, or may be operated by hand. At step 612, when the shotcrete has cured, the user places a traditionally designed roof (i.e., trusses) with holes drilled into the wood timber onto the first and second shafts 106A, 106B of the brackets 100 in the dome roof and couples the traditionally designed roof using fasteners (e.g., nut and washer) on the first and second shafts 106A, 106B. At step 614, the user may erect a second structure (e.g., wood-framed structure) around the first structure and couple it thereto.

In some embodiments, an air inflated form(s) may be utilized with either a robotic (e.g., a central robotic arm) or handheld sprayer to apply, for example, high velocity shotcrete thereto. 3D printed walls may also be positioned on an upper surface or a lower surface of the inflated form using a cementitious material. In some embodiments, an automated gantry crane may be used to apply a concrete mix under or on top of the air inflated form.

In one embodiment, steel or concrete premade arches may be used with a monolithic roof. A cementitious mix then may be applied to form the monolithic roof with the walls. In some embodiments, sensors may be used in the system to adjust to cement depths being applied to the inner or outer surfaces of the dome. In other words, sensors may be configured so that the shotcrete, or another compound, is applied evenly and at a predetermined depth.

It will be understood that while various embodiments have been disclosed herein, other embodiments are contemplated. Further, systems and/or methods according to certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A method of constructing a structure comprising:
constructing a dome with walls and a roof;
fastening a one or more brackets into the roof of the dome, the one or more brackets comprising a platform, one or more shafts protruding from an upper surface of the platform, and one or more panels protruding from a lower surface of the platform;
spraying an inner surface of the walls and the roof of the dome with foam;
inserting a predetermined length of a plurality of wires into the foam, leaving a portion of the plurality of wires extending from the foam;
fastening rebar to the portion of the plurality of wires extending from the foam;
spraying shotcrete over the inner surface of the walls and roof, covering the foam, the plurality of wires, and the rebar;
fastening trusses to the one or more brackets extending upward from an outer surface of the roof of the dome; and
constructing a first structure around the dome, the first structure comprising the trusses.

2. The method of claim 1, wherein the walls and the roof of the first dome structure are defined by a membrane material.

3. The method of claim 2, wherein the membrane material comprises a polyvinyl chloride material.

4. The method of claim 1, further comprising erecting and defining the dome by a material selected from the group consisting of tarps, cloth fabrics, and insulated concrete forms.

5. The method of claim 1, wherein the foam comprises spray polyurethane foam.

6. The method of claim 1, wherein a robotic sprayer is programmed to apply the shotcrete.

7. The method of claim 1, further comprising applying the shotcrete to the inner surface of the dome with a robotic sprayer via a robotic arm.

8. The method of claim 1, further comprising coupling the robotic sprayer to an elevating member selected from the group consisting of a man lift, a fork lift, and a crane.

9. The method of claim 1, further comprising hand spraying shotcrete on the inner surface of the roof and walls.

10. The method of claim 1, further comprising programming a robotic sprayer to spray a predetermined amount of foam and shotcrete inside of and over the dome.

11. The method of claim 1, further comprising initiating a robotic sprayer to spray shotcrete over the inner surface of the walls and roof, covering the foam, the plurality of wires, and the rebar.

12. The method of claim 1, wherein the one or more shafts comprise a first shaft and a second shaft.

13. The method of claim 1, wherein the one or more panels comprise a first panel and a second panel.

14. The method of claim 1, further comprising inserting plates into the roof of the dome.

15. The method of claim 14, wherein the plates inserted into the roof comprise knife plates that allow a second story to be constructed in the dome.

16. A method of constructing a structure comprising:
constructing a dome with walls and a roof;
fastening one or more brackets into the roof of the dome, the one or more brackets comprising:
a platform,
a first shaft and a second shaft coupled to and extending from an upper surface of the platform, the first and second shafts being perpendicular to the platform, and
a first panel and a second panel coupled to and extending from a lower surface of the platform, the first and second panels being perpendicular to the platform;
spraying the walls and the roof of the dome with foam;
initiating a robotic sprayer to spray shotcrete over the inner surface of the walls and roof;
fastening trusses to the first and second shafts that extend upward from an outer surface of the dome; and
constructing a first structure around the dome, the first structure comprising the trusses.

17. The method of claim 16, further comprising inserting a plurality of wires into the foam.

18. The method of claim 17, further comprising fastening the plurality of wires to the first and second panels of the one or more brackets.

19. The method of claim 18, further comprising fastening a plurality of rebar shafts to the plurality of wires.

20. A method of constructing a structure comprising:
constructing dome with walls and a roof;
fastening one or more brackets into the roof of the dome, the one or more brackets comprising:
a platform,
a first shaft and a second shaft extending from an upper surface of the platform, the first and second shafts being perpendicular to the platform, and
a first panel and a second panel that extend from a lower surface of the platform, the first and second panels being perpendicular to the platform;
inserting plates into the roof of the dome;
spraying an inner surface of the walls and the roof of the dome with foam;
inserting a predetermined length of a plurality of wires into the foam, leaving a portion of the plurality of wires extending from the foam;
fastening rebar to the portion of the plurality of wires extending from the foam;
programing a robotic sprayer to the dimensions of the dome;
initiating the robotic sprayer to spray shotcrete over the inner surface of the walls and roof, covering the foam, the plurality of wires, and the rebar;
fastening trusses to the one or more brackets extending upward from an outer surface of the roof of the dome; and
constructing a first structure around the dome, the first structure comprising the trusses.

* * * * *